United States Patent [19]

Itabashi et al.

[11] Patent Number: 4,909,497

[45] Date of Patent: Mar. 20, 1990

[54] PRINTER PAPER FEED APPARATUS

[75] Inventors: Akio Itabashi; Satomi Nanaumi, both of Koshigaya, Japan

[73] Assignee: Copal Company Limited, Tokyo, Japan

[21] Appl. No.: 199,777

[22] Filed: May 27, 1988

[30] Foreign Application Priority Data

May 30, 1987 [JP] Japan ..... 62-136922

[51] Int. Cl.[4] ..... B41J 11/00

[52] U.S. Cl. ..... 271/9; 271/264; 226/101; 400/605

[58] Field of Search ..... 271/3, 9, 264, 271, 271/273, 274; 226/110, 74, 75, 101, 102; 400/605, 690.4, 616.2

[56] References Cited

U.S. PATENT DOCUMENTS

| | | | |
|---|---|---|---|
| 3,880,016 | 4/1975 | Jamieson et al. . | |
| 4,475,833 | 10/1984 | Sawicki . | |
| 4,504,161 | 3/1985 | Volke et al. | 400/605 |
| 4,564,305 | 1/1986 | Rekewitz et al. | 400/605 |
| 4,572,418 | 2/1986 | Hirata | 226/101 X |
| 4,663,722 | 5/1987 | Sato | 400/605 X |
| 4,742,946 | 5/1988 | Hamamichi et al. | 226/74 |
| 4,743,132 | 5/1988 | Chikata et al. | 271/3 X |
| 4,761,663 | 8/1988 | Piatt et al. | 271/9 X |

FOREIGN PATENT DOCUMENTS

| | | | |
|---|---|---|---|
| 0090401 | 10/1983 | European Pat. Off. | 271/3 |
| 0295172 | 12/1988 | European Pat. Off. . | |
| 3606060 | 4/1987 | Fed. Rep. of Germany | 400/605 |
| 0073980 | 4/1984 | Japan | 400/605 |
| 0078875 | 5/1984 | Japan | 400/605 |
| 0190377 | 9/1985 | Japan | 400/605 |
| 0205161 | 9/1986 | Japan | 400/605 |
| 0273450 | 12/1986 | Japan | 271/264 |
| 0140944 | 6/1987 | Japan | 271/9 |
| 8706532 | 11/1987 | World Int. Prop. O. | 400/605 |

OTHER PUBLICATIONS

IBM Technical Disclosure Bulletin, vol. 25, No. 1, Jun. 1982, Platen Backup Rollers, pp. 202–203, Ramirez and Souliere.

*Primary Examiner*—Joseph J. Rolla

*Attorney, Agent, or Firm*—Finnegan, Henderson, Farabow, Garrett & Dunner

[57] ABSTRACT

A printer paper feed apparatus having a single-form feed function and a continuous-form feed function, in which a pin tractor mechanism for feeding the continuous forms is situated upstream of the platen in terms of paper feed. The apparatus includes a guide plate member for the single forms having a base end pivotally supported in the vicinity of a single-form insertion inlet formed in an upper side of a printer main body, the guide plate member being capable of selectively assuming a horizontally accommodated position and a paper insertion guide position at which it is raised in an inclined attitude, a clutch mechanism provided in a rotating force transmission system between a tractor drive shaft of the pin tractor mechanism and the paper feed motor, and a clutch control mechanism for controlling engagement and disengagement of the clutch means in dependence upon whether the guide plate member is situated at the accommodated position or the single-form insertion guide position. When the guide plate member is situated at the single-form insertion guide position, the clutch mechanism is placed in a state in which the rotating force cannot be transmitted from the paper feed motor to the tractor drive shaft, thereby terminating drive of the pin tractor mechanism.

14 Claims, 9 Drawing Sheets

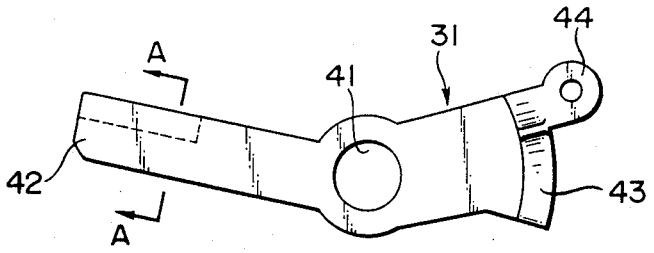
FIG. 10A
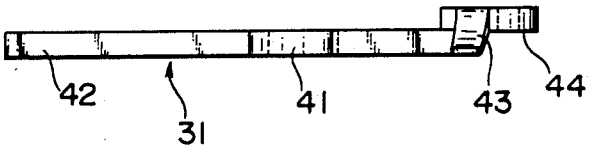
FIG. 10B
FIG. 10C
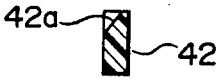
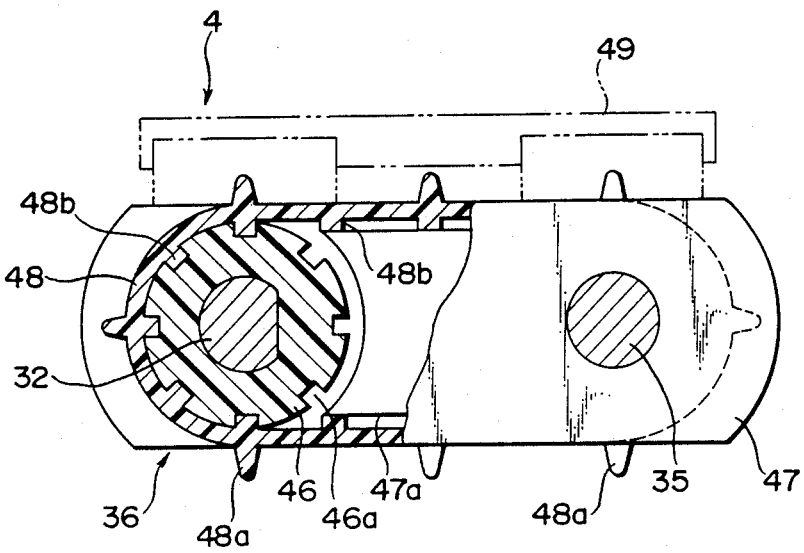
FIG. 11

PRINTER PAPER FEED APPARATUS

BACKGROUND OF THE INVENTION

1. Field of the Invention:

This invention relates to a printer paper feed apparatus having a single-form feeding function and a continuous-form feeding function. More particularly, the invention relates to a paper feed apparatus well-suited for application to a printer of the type which employs a so-called "push-feed method" wherein a pin tractor mechanism for feeding the abovementioned continuous forms is situated upstream of a platen in terms of the paper feed direction.

2. Description of the Prior Art:

Printers well-known in the art have a friction paper feed mechanism for feeding single forms by a platen and driven pressure rollers, and a pin tractor mechanism for feeding continuous forms.

These printers include ones in which feed is accomplished by employing a so-called "push-feed method" wherein the pin tractor mechanism is located upstream of the platen in the paper feed direction. In comparison with a so-called "pull-feed method" in which the pin tractor mechanism is situated downstream of the platen in terms of paper feed, adopting the push-feed method is advantageous in that a smaller blank portion or "dead space" is required at the leading edge of the continuous forms.

Generally, in a printer having the abovementioned friction paper feed mechanism for single forms and pin tractor mechanism for continuous forms, a single motor is used as the driving source for both mechanisms and it is arranged so that the platen and a tractor driver shaft in the pin tractor mechanism are rotated synchronously at all times. Consequently, when single forms are used, it is required to remove the continuous forms from the pin tractor mechanism. Then, when it is desired to use the continuous forms again, these forms must be reloaded on the pin tractor mechanism. However, as is widely known in the art, engaging the pins of the pin tractor mechanism with the perforations on both side edges of the continuous forms is a fairly troublesome and laborious task for the operator to perform.

However, if an arrangement is adopted in which the rotating force is cut off from the pin tractor mechanism when the single forms are used in the aforementioned printer which feeds the continuous forms by the push-feed method, then this will make it possible to maintain the leading edge portion of the continuous forms in engagement with the pins of the pin tractor mechanism even when the apparatus is used to feed the single forms. Accordingly, it has been contemplated to provide clutch means in the rotation transmission system between the abovementioned paper feed motor and the tractor drive shaft of the pin tractor mechanism, and adopt an arrangement in which the clutch means is operated by hand using a manual operation lever so that the transmission of rotating force to the pin tractor mechanism can be cut off when the single forms are used. However, in a case where the operating lever for clutch control is provided, it is essential that the operator manipulate the lever properly and without fail. More specifically, if the operator inserts a single form into the printer without selecting the single form mode by the operating lever in a state where the leading edge of the continuous forms has been left mated with the pins of the pin tractor mechanism, both the single form and the continuous forms will be fed at the same time.

SUMMARY OF THE INVENTION

An object of the present invention is to provide a paper feed apparatus in a printer of the type having a single-form feeding function and a continuous-form feeding function, with a pin tractor mechanism for feeding the continuous forms being situated upstream of a platen in terms of paper feed, in which apparatus the operator is capable of cutting off the transmission of rotating force to the pin tractor mechanism in a simple and reliable manner when single forms are used.

In a printer of the abovementioned type, raising a guide plate member to a position at which paper is guided for insertion is an operation which the operator must always perform when a single form is used. This operation is necessary to register the single form with an insertion position that depends upon the size of the single form and to insert the single form in parallel with a datum line on the platen. Furthermore, since the horizontal position and the raised position of the guide plate member differ greatly from each other, the operator cannot help but notice that the guide plate member is in the raised attitude.

Accordingly, another object of the invention is to provide a printer paper feed apparatus in which the transmission of rotating force to the pin tractor mechanism can be cut off simply and reliably by raising the guide plate member to the paper insertion guide position, this operation being one which is always performed when using single forms.

Still another object of the invention is to provide a printer paper feed apparatus in which single forms can be used even when continuous forms are left engaged with a pin tractor mechanism.

A further object of the invention is to provide a printer paper feed apparatus in which driven pressure rollers are brought into pressured contact with a platen in reliable fashion when a single form is used, and the driven pressure rollers are separated away from the platen in reliable fashion when continuous forms are used.

Yet another object of the invention is to provide a printer paper feed apparatus in which, when a single form is used, transmission of rotating force to a pin tractor mechanism is cut off and driven pressure rollers are brought into pressured contact with a platen to make feeding of the single form possible, and when continuous forms are used, rotating force is transmitted to the pin, tractor mechanism and the driven pressure rollers are separated from the platen in a reliable manner.

According to the present invention, the foregoing objects are attained by providing a printer paper feed apparatus comprising: a platen rotated by a paper feed motor; driven pressure rollers for feeding a single form in cooperation with the platen; a pin tracter mechanism situated upstream in terms of paper feed as seen from the platen for feeding continuous forms; a guide plate member for the single forms having a base end pivotally-supported in the vicinity of a paper insertion inlet formed in an upper side of a printer main body, the guide plate member being capable of selectively assuming a horizontally accommodated position and a paper insertion guide position at which it is raised to an inclined attitude; clutch means provided in a rotating force transmission system between a tractor drive shaft of the pin tractor mechanism and the motor; and clutch control means for controlling engagement and disengagement of the clutch means in dependence upon whether the guide plate member is situated at the accommodated position or the paper insertion guide position; wherein when the guide plate member is situated at the paper insertion guide position, the clutch means is placed in a state in which the rotating force cannot be transmitted from the motor to the tractor drive shaft, thereby terminating drive of the pin tractor mechanism.

Thus, in accordance with the invention, the clutch means is provided in the rotating force transmission system between the pin tractor mechanism and the paper feed motor, and the clutch control means controls the engagement and disengagement of the clutch means depending upon whether the guide plate member for inserting and guiding the single forms is located at the accommodated position or paper insertion guide position. Accordingly, the transmission of rotating force to the tractor mechanism can be interrupted merely by turning the guide plate member from the horizontal state (accommodated position) to the upstanding state at the paper insertion guide position.

Further, in accordance with the present invention, there is provided a paper feed apparatus for printer having a platen rotatively driven by a paper feed motor and equipped with a single-form feed function and a continuous-form feed function, the paper feed apparatus comprising: driven pressure rollers capable of assuming a first position for feeding single forms in cooperation with the platen, and a second position at which the driven pressure rollers are spaced away from the platen; a pin tractor mechanism situated upstream in terms of paper feed as seen from the platen for feeding continuous forms; a guide plate member for the single forms having a base end pivotally supported in the vicinity of a paper insertion inlet formed in an upper side of a printer-main body, the guide plate member being capable of selectively assuming a horizontally accommodated position and a single-form insertion guide position at which it is raised to an inclined attitude; clutch means provided in a rotating force transmission system between a tractor drive shaft of the pin tractor mechanism and the paper feed motor; clutch control means for controlling engagement and disengagement of the clutch means in dependence upon whether the guide plate member is situated at the accommodated position or the single-form insertion guide position; and roller transfer means for transferring the driven pressure rollers to the first and second positions in dependence upon whether the guide plate member is situated at the accommodated position or the single-form insertion guide position.

In accordance with an embodiment of the invention, the clutch means includes a gear capable of sliding along a rotary shaft, which is rotated by the paper feed motor, between a first position at which the gear meshes with a drive gear for driving the drive shaft of the pin tractor mechanism, and a second position at which the gear is taken out of mesh with the drive gear.

Further, the clutch control means includes a lever supported on a shaft and turnable about the shaft, the lever having a first end portion for engaging a projection on the guide plate member, and a tapered portion provided in the vicinity of a second end opposite the first end, wherein when the guide plate member is raised, the first end engages the projection to turn the lever, the gear being slidingly shifted to the second position by the tapered portion of the lever.

The paper insertion inlet has a single-form insertion opening and a continuous-form insertion opening which are partitioned from each other by a partitioning member, the continuous-form insertion opening being provided below the single-form insertion opening.

The pin tractor mechanism is disposed below the guide plate member in the accommodated position.

The guide plate member is adapted so as to be detachable from the printer main body.

When the guide plate member is raised, arcuate flexible tip portions provided at lower portions of respective side pieces provided on both sides of the guide plate member engage an upper portion of a printer cabinet so that the guide plate member is held at an inclination of about 60°. The roller transfer means includes a lever supported on a shaft and turnable about the shaft, the lever having a first end portion for engaging a projection on the guide plate member, and a cam portion provided in the vicinity of a second end opposite the first end, a support shaft of the driven pressure rollers sliding the cam portion so that the driven pressure rollers are capable of assuming the first and second positions.

The paper feed apparatus further includes a manual lever capable of moving the driven pressure rollers between the first and second positions, wherein the driven pressure rollers are manually movable to the second position to cancel cooperation between the driven pressure roller and the platen even when the driven pressure rollers have been been moved to the first position by the roller transfer means.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIGS. 10A through 10C are a plan view of the changeover lever, a front view of the same and a sectional view taken along line A—A of FIG. 10A, respectively;

FIG. 11 is an explanatory view of a pin tractor mechanism;

DESCRIPTION OF THE PREFERRED EMBODIMENT

A first embodiment of the present invention shown in FIGS. 1 through 13 will now be described.

Figure 1:
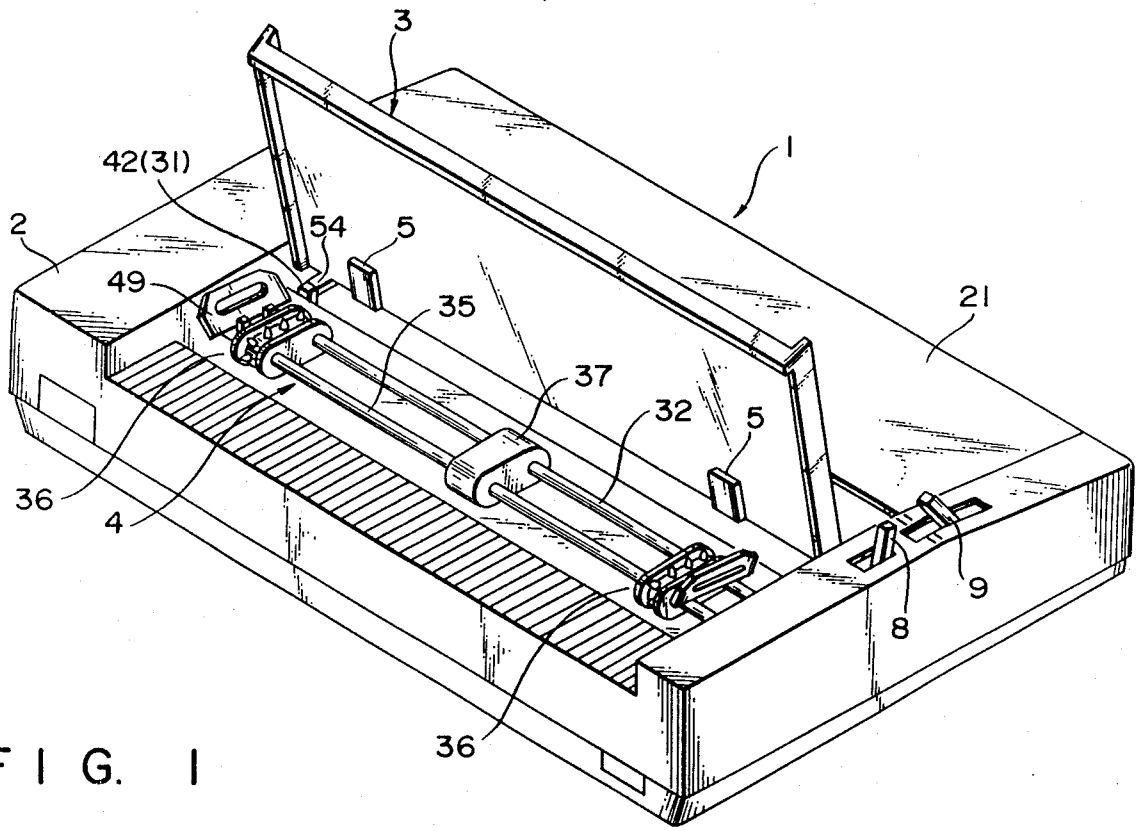
FIG. 1 is a perspective view illustrating the entirety of a printer in which a guide plate member at a paper insertion guide position is seen from the back side.
Figure 2:
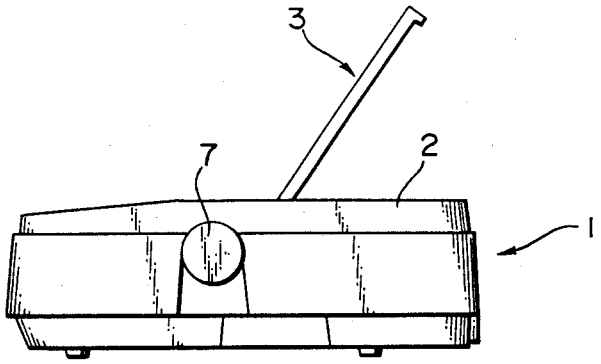
FIG. 2 is a side view showing the same condition.
Figure 3:
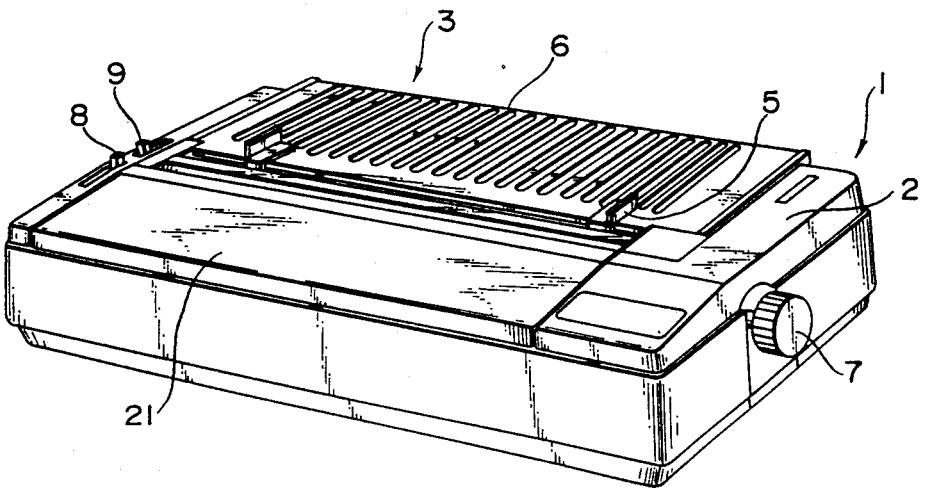
FIG. 3 is a perspective view in which the guide plate member at an accommodated position is seen from above a front side.
Figure 4:
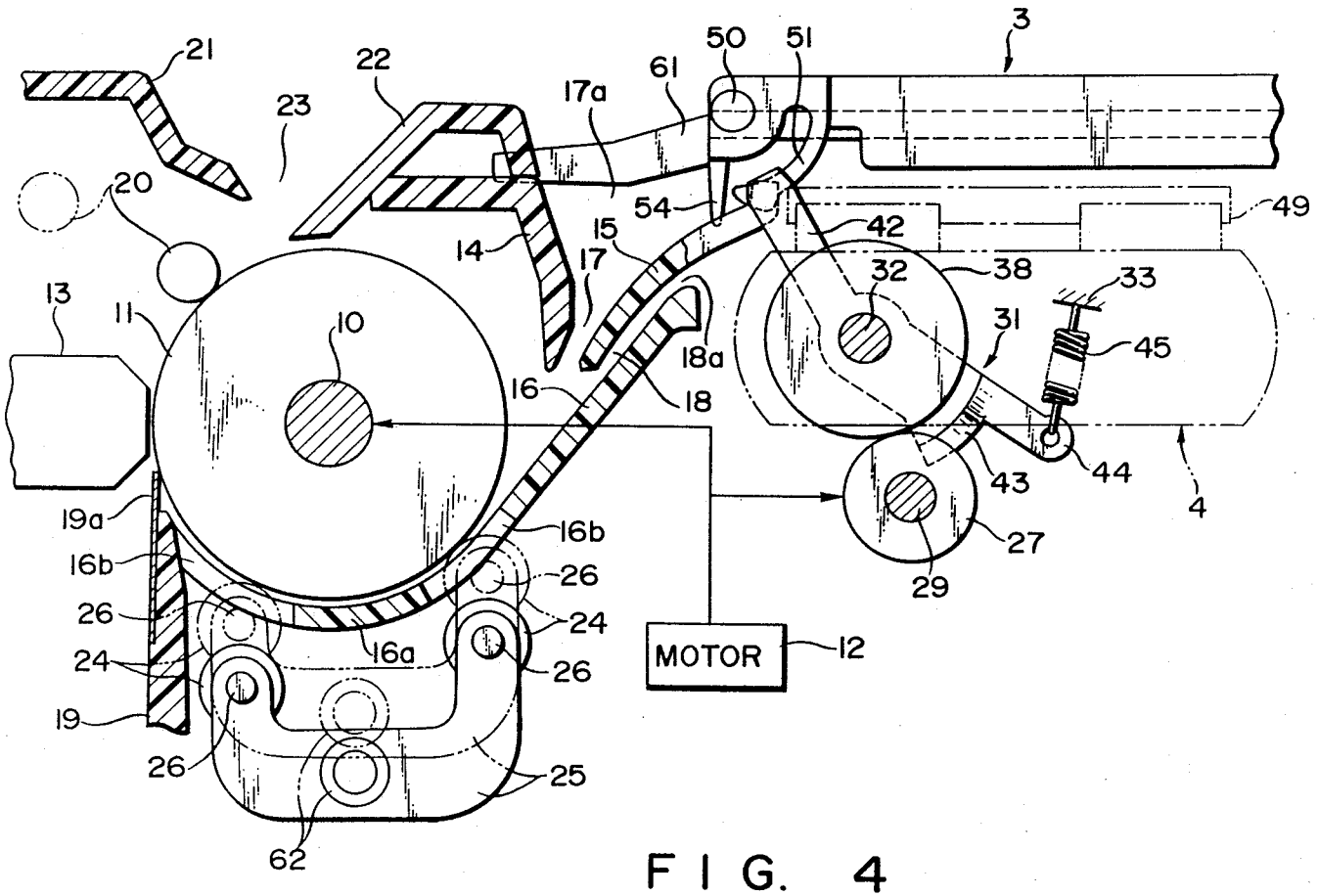
FIG. 4 is an explanatory view in which the guide plate member at the accommodated position is seen from the side.
Figure 5:
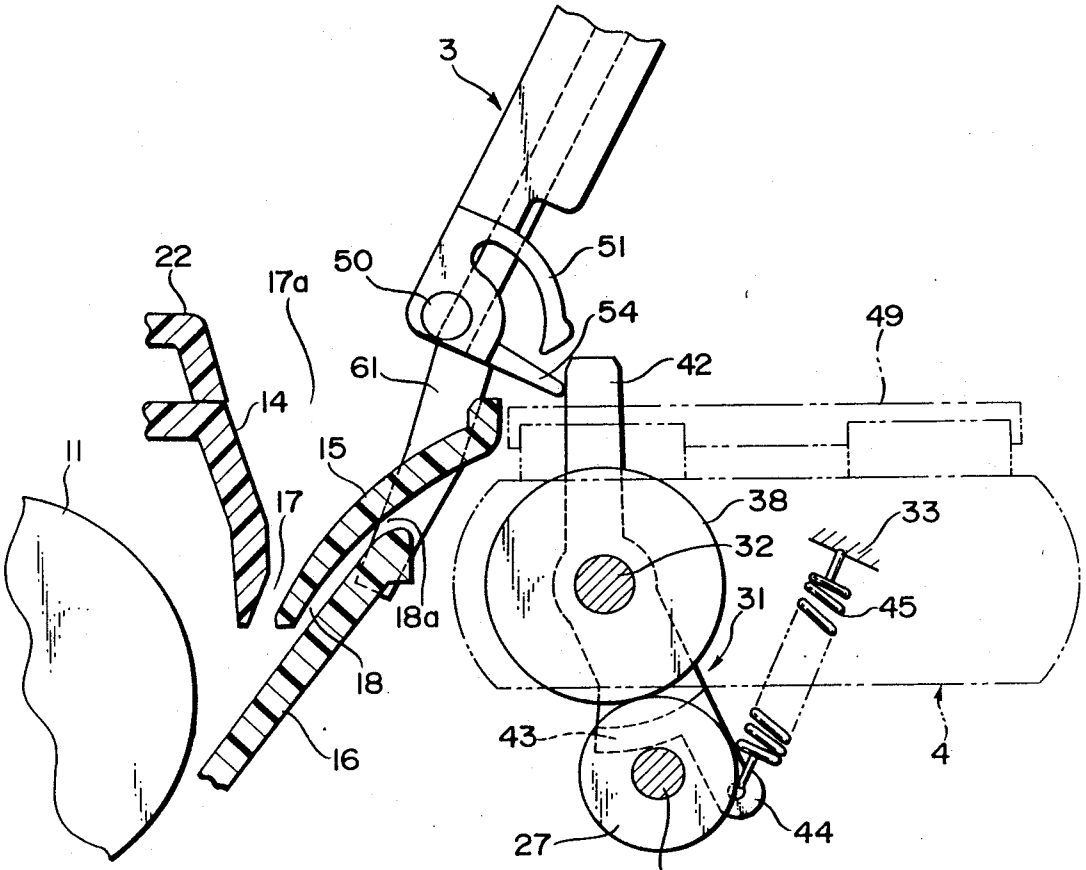
FIG. 5 is an explanatory view in which the guide plate member at the paper insertion guide position is seen from the side.
Figure 6:
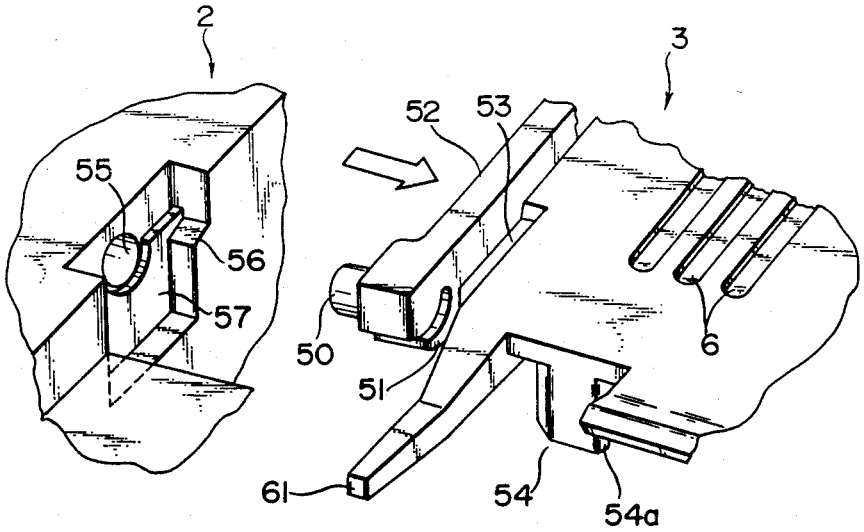
FIG. 6 is a perspective view showing an operation for attaching the guide plate member to a top cabinet.
Figure 7:
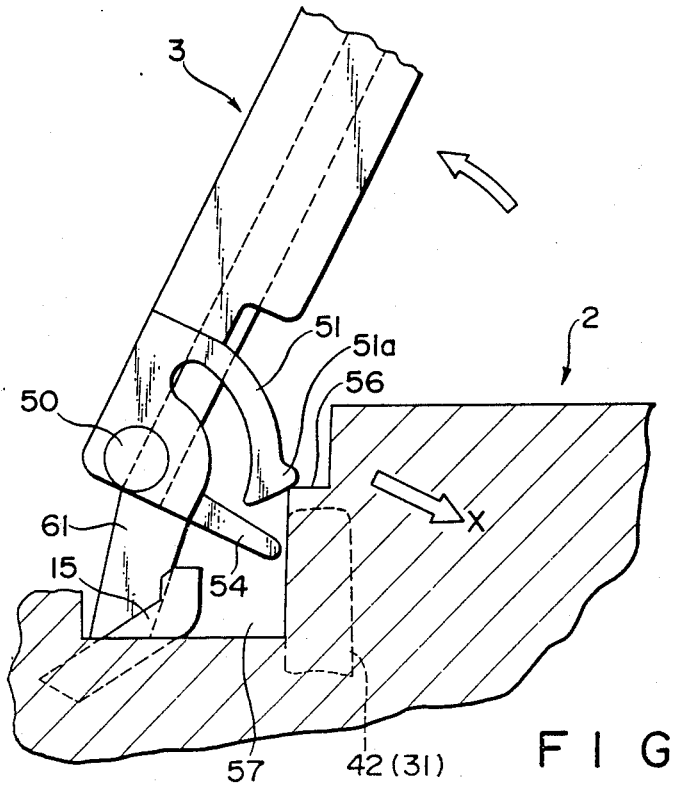
FIG. 7 is an explanatory view in which the guide plate member at the paper insertion guide position is shown in a locked state.
Figure 9:
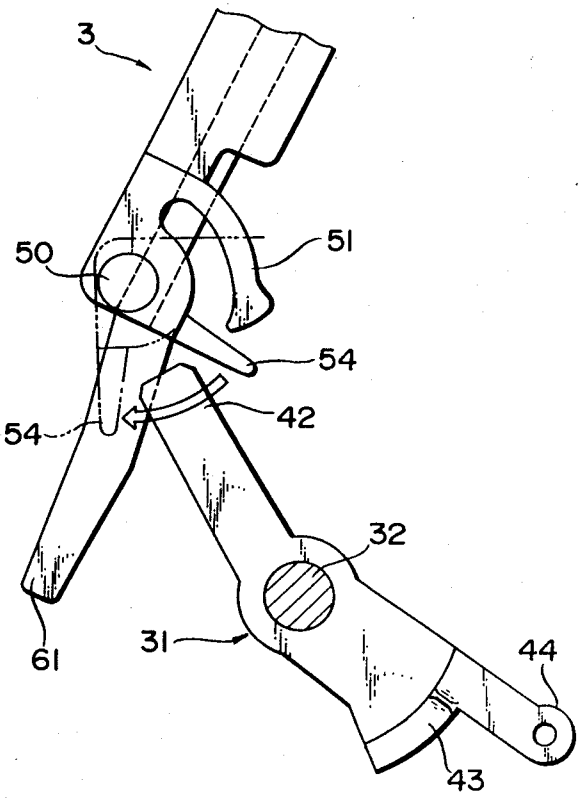
FIG. 9 is an explanatory view showing motion of the guide plate member when it is being attached to the top cabinet.
Figure 8:
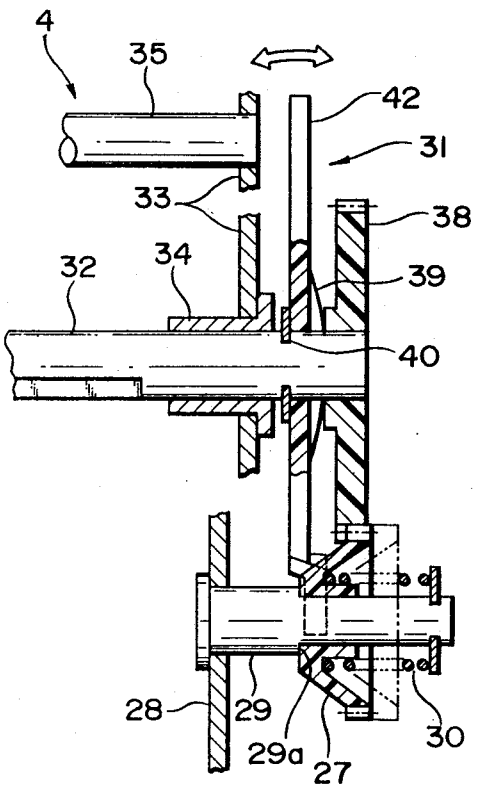
FIG. 8 is a sectional view showing the relationship between a changeover lever and a clutch mechanism.

FIG. 1 is a perspective view illustrating the entirety of a printer in which a guide plate member at a paper insertion guide position is seen from the back side; FIG. 2 is a side view showing the same condition; FIG. 3 is a perspective view in which the guide plate member at an accommodated position is seen from above a front side; FIG. 4 is an explanatory view in which the guide plate member at the accommodated position is seen from the side; FIG. 5 is an explanatory view in which the guide plate member at the paper insertion guide position is seen from the side; FIG. 6 is a perspective view showing an operation for attaching the guide plate member to a top cabinet; FIG. 7 is an explanatory view in which the guide plate member at the paper insertion guide position is shown in a locked state; FIG. 8 is a sectional view showing the relationship between a changeover lever and a clutch mechanism; FIG. 9 is an explanatory view showing motion of the guide plate member when it is being attached to the top cabinet; FIGS. 10A through 10C are a plan view of the changeover lever, a front view of the same and a sectional view taken along line A—A of FIG. 10A, respectively; and FIG. 11 is an explanatory view of a pin tractor mechanism.

As shown in FIGS. 1 through 3, a printer main body indicated generally at numeral 1 has a top cabinet 2 to which a guide plate member 3 is attached so as to be free to turn up and down. The guide plate member 3 is for guiding single forms into the printer main body 1 and is capable of selectively assuming a horizontal accommodated position and a paper insertion guide position at which the guide member is uprighted at a prescribed angle of inclination with respect to the horizontal. A pin tractor mechanism 4 for feeding continuous forms is exposed when the guide plate member 3 is at the paper insertion guide position, as shown in FIG. 1, and is covered by the guide plate member 3 when the latter is at the accommodated position, as illustrated in FIG. 3. In FIGS. 1 through 3, numerals 5, 5 denote paper side edge regulating pieces slidably attached to the base side of the guide plate member 3. Numeral 6 denotes ribs formed on the front side of the guide plate member 3. Numeral 7 denotes a knob for manually manipulating a platen, described below. Shown at numeral 8 is a handle for controlling the contact pressure of a driven pressure roller, described below. Numeral 9 designates a handle for controlling the contact pressure of a bail roller, also described below.

In FIG. 4 wherein only portions related to the present invention are shown in simplified form, a platen shaft 10 is freely rotatably supported between mechanism side frames, not shown, inside the printer main body 1. A platen 11 extending along the platen shaft 10 is fixedly secured thereto. A paper feed motor 12 has an output shaft coupled to the platen shaft 10 via a gear train.

Numeral 13 denotes a wire dot-type printing head only the nose portion of which is shown in order to simplify the illustration. The printing head 13 is mounted on a well-known carriage, not shown, and is capable of being reciprocated along the platen 11.

Numerals 14, 15 and 16 denote paper guides. A guide path 17 for single forms is defined by the paper guides 14, 15, and a guide path 18 for continuous forms is defined by the paper guides 15, 16. The upper portion of the guide path 17 serves as a single-form insertion inlet 17*a* situated near the base of the freely turnable guide plate member 3 and is adapted to receive single forms, which drop slidingly along the raised guide plate member 3 in the paper insertion guide position, and to introduce these single forms to the periphery of the platen 11. The upper right end of the guide path 18 in the figures serves as a receiving port 18*a* situated near a paper delivery section of the pin tractor mechanism 4 and is adapted to receive continuous forms, which are fed by the pin tractor mechanism 4, and to introduce these continuous forms to the periphery of the platen 11.

The lower portion of the paper guide 16 defines an arcuate guide portion 16*a* extending along the platen 11 and adapted to guide the paper, which is introduced from the guide path 17 or 18, to the space between the printing head 13 and the platen 11 via the lower portion of the platen 11. A flexible, thin guide plate 19*a* is disposed on a support member 19 and functions to reliably feed the paper guided by the paper guide 16 into the small gap between the printing head 13 and platen 11.

A bail roller 20 is capable of being selectively placed by operation of the handle 9 at a position (indicated by the solid line in FIG. 4) where it is brought into pressured contact with the platen 11 and a position (indicated by the two-dot chain line in FIG. 4) where it is spaced away from the platen 11. When in pressured contact with the platen 11 at the position indicated by the solid line in FIG. 4, the bail roller 20 presses the paper, which has emerged from between the printing head 13 and platen 11, against the upper portion of the platen 11, and leads the paper to a paper discharge port 23 between a transparent cover 21 and a paper guide 22 attached to the top cabinet 2.

Driven pressure rollers 24, 24 are supported by respective shafts 26 on a roller support member 25 and can be placed selectively at a position in pressured contact with the platen 11 and a position spaced away from the platen 11 by operating the handle 8 or when the the guide plate member 3 is located at the position shown in FIG. 4 or FIG. 5, as will be described later. The driven pressure rollers 24, 24 contact or separate from the platen 11 via respective through-holes 16*b*, 16*b* formed in the paper guide 16. When in pressured contact with the platen 11 at the positions indicated by the two-chain lines in FIG. 4, the driven pressure rollers 24, 24 cooperate with the platen 11 to form a friction paper feed mechanism adapted to feed single forms in response to rotation of the motor 12. When continuous forms are fed by the pin tractor mechanism 4 described below, the driven pressure rollers 24, 24 are brought to the position spaced away from the platen, as indicated by the solid lines in FIG. 4.

A clutch gear 27 is selectively coupled to the paper feed motor 12 via a gear train. More specifically, though the clutch gear 27 is shown in simplified form in FIGS. 4 and 5, the clutch gear 27 is mounted on a support shaft 29, which is fixedly secured to a mechanism side frame 28, so as to rotate freely on the shaft and slide freely a predetermined amount axially of the shaft, as shown in FIG. 8. The clutch gear 27 is biased to the left in FIG. 8 (into the page in FIG. 4) by a spring 30. When a changeover lever 31, described below, is located at a rotation position shown in FIG. 4, the clutch gear 27 is in abutting contact with a stepped portion 29a of the support shaft 29, as indicated by the solid line in FIG. 8. At this time the clutch gear 27 is meshing with the gear train from the motor 12.

As shown in FIGS. 1, 4, 5, 8 and 11, the pin tractor mechanism mechanism 4 has a tractor drive shaft 32 both ends of which are supported via bearings 34 on a pair of tractor side frames 33 (only one of which is shown), as shown in part in FIG. 8, in such a manner that the drive shaft 32 is free to rotate only. A guide shaft 35 lying parallel to the tractor drive shaft 32 spans the pair of tractor side frames 33 and has its ends fixedly secured to respective ones of these side frames. A pair of pin feeders 36, 36 and, when necessary, a paper stay 37 (see FIG. 1) are fitted on the tractor drive shaft 32 and guide shaft 35. The entire pin tractor mechanism 4 is placed and positioned on a support portion (not shown) of the printer main body 1, whereby the pin tractor mechanism 4 is mounted at the position shown in each of the Figures. (It should be noted that the pin tractor mechanism 4 can be detached when required.)

One end of the tractor drive shaft 32 projects outwardly from one of the tractor side frames 33, as shown in FIG. 8, and a tractor drive gear 38 is fixedly secured to the tip of this projecting end. The tractor drive gear 38 is free to mesh with the clutch gear 27. When the clutch gear 27 is in the position indicated by the solid line in FIG. 8 (which position corresponds to the position shown in FIG. 4), the drive gear 38 meshes with the clutch gear 27. When the clutch gear 27 is placed in the position indicated by the two-dot chain line in FIG. 8 (which position corresponds to the position shown in FIG. 5) by operation of the changeover lever 31, which is described below, the tractor drive gear 38 is disconnected from the clutch gear 27.

The changeover lever 31 is freely rotatably supported on the tractor drive shaft 32 and is resiliently urged toward a positioning washer 40 on the tractor drive shaft 32 by a leaf spring 39 interposed between the changeover lever 31 and the tractor drive gear 38.

As shown in FIG. 10, the changeover lever 31 has a central hole 41, an operated portion 42 which includes a slanted portion 42a, a drive cam portion 43, and a spring anchoring portion 44. As illustrated in FIG. 4, the changeover lever 31 is biased to turn counter-clockwise in FIG. 4 by a spring 45 stretched between the spring anchoring portion 44 and the tractor side frame 33. In FIG. 4, the changeover lever 31 is at its counter-clockwise limit position where it abuts against a stopper, not shown. When the changeover lever 31 is turned clockwise against the force of spring 45 from the state shown in FIG. 4 to the position shown in FIG. 5, the changeover lever 31 shifts the clutch gear 27 rightward in FIG. 8 against the force of spring 30 by means of its drive cam portion 43, whereby the clutch gear 27 is brought to the position indicated by the two-dot chain line in FIG. 8.

The pair of pin feeders 36 of the pin tractor mechanism 4 employs an arrangement using, for example, a well-known pin belt or well-known pin wheel. In the illustrated embodiment, the pin-belt arrangement is adapted, as shown in FIG. 11. In FIG. 11, numeral 46 denotes a drive wheel splined to the tractor drive shaft 32. Numeral 47 designates a feeder base having a belt winding portion 47a. Shown at numeral 48 is a pin belt having pins 48a. The pin belt 48 is wound upon the outer peripheries of the drive wheel 46 and belt winding portion 47a and has toothed portions 48b on its inner surface that mesh and engage with recesses 46a formed in the drive wheel 46.

Accordingly, when the clutch gear 27 is in a rotation transmitting state (the solid-line position in FIG. 8) where it is meshing with the gear train from the motor 12 and the tractor drive gear 38, the rotating force of the motor 12 is transmitted via the gear train (not shown), the clutch gear 27 and the tractor drive gear 38 to the drive wheel 46 which rotates in unison with the tractor drive shaft 32. As a result, the pin belt 48 is driven to feed the continuous forms engaged with the pin belt 48. It should be noted that the two-dot chain line in FIG. 11 indicates a well-known paper stay 49 attached to the feeder base 47. The paper stay 49 is capable of being placed selectively in an open position (see FIG. 1) that allows the continuous forms to be engaged with and disengaged from the pin belt 48, and a position at which the stay holds down the edge of the paper.

Support shafts 50 are projectingly formed on both side edges of the base portion of guide plate member 3. Only one of these support shafts is shown (FIGS. 4, 5, 6, 7 and 9) for the sake o simplifying the illustration. As shown in FIG. 6, the support shafts 50 are inserted into support holes 55 (only one of which is shown) formed in the top cabinet 2. As a result, the guide plate member 3 is held on the top cabinet 2 so as to be freely rotatable about the support shafts 50 at both sides of the base portion.

As shown in FIG. 6, the guide plate member 3 is formed to include a side piece 52 having an arcuate resilient part 51 situated inwardly of the support shaft 50, and a cut groove 53 situated on the inner side of the side piece 52. The insertion of the support shafts 50 into the support holes 55 is performed in such a manner that the side pieces 52 are caused to flex inwardly. After the support shafts 50 are inserted, the side pieces 52 undergo self-restoration, whereby the guide plate member 3 is prevented from falling out. Thus, after the guide plate member 3 is attached, it can be detached and reattached whenever required.

A cut-out 57 having a stepped portion 56 is formed in the vicinity of each of the support holes 55 of top cabinet 2, as depicted in FIG. 6. When, as shown in FIG. 7, the guide plate member 3 is turned from the horizontal accommodated position and raised to the paper insertion guide position after being attached, a projection 51a at the tip of the arcuate resilient piece 51 comes into resilient contact with the stepped portion 56 and applies a force in the direction of arrow X in FIG. 7, whereby the guide plate member 3 is reliably retained at the paper insertion guide position at an inclined angle of about 60° with respect to the horizontal.

As best seen in FIG. 6, a driving projection 54, which is capable of driving the operated portion 42 of the changeover lever 31, is formed on one side of the base portion of guide plate member 3 so as to be perpendicular to the main face of the guide plate member 3. When the guide plate member 3 is in the accommodated position (the horizontal position), the driving projection 54 is spaced a predetermined distance away from the operated portion 42 of the changeover lever 31, which is located at the counter-clockwise limit position, by the spring 45, as shown in FIG. 4. By manually manipulating the guide plate member 3 to turn it counter-clockwise from this position and raise it to the paper insertion guide position shown in FIGS. 5 and 7, the driving projection 54 urges the operated portion 52 of changeover lever 31 as the guide plate member 3 is turned, thereby turning the changeover lever 31 clockwise against the force of spring 45. As a result, the changeover lever 31 shifts the clutch gear 27 rightward in FIG. 8 by means of its driving cam portion 43, so that the clutch gear 27 and tractor drive gear 38 are disconnected.

It should be noted that the guide plate member 3 is reliably retained upright in the inclined attitude at the paper insertion guide position by the action of the arcuate resilient piece 51 of the guide plate member 3, and the changeover lever 31 and guide plate member 3 naturally return from the position shown in FIG. 5 to the state shown in FIG. 4 owing to the spring 45 of the changeover lever 31. When the guide plate member 3 is turned clockwise manually from the state shown in FIGS. 4 and 5 against the biasing force of the arcuate resilient member 51, the guide plate member 3 is returned to the state shown in FIG. 4 and the changeover lever 31 is rotated counter-clockwise and restored to the position shown in FIG. 4 by the tensioning force of the spring 45. Accordingly, the clutch gear 27, from which the axial urging force applied by the drive cam portion 43 of changeover lever 31 has been removed, is restored from the two-dot chain line position of FIG. 8 to the solid-line position by the biasing force of the spring 30, thereby making it possible for the rotating force to again be transmitted from the motor 12 to the tractor drive gear 38.

FIG. 9 is a view for describing an operation through which the driving projection 54 rides up on the operated portion 42 of changeover lever 31 when the guide plate member 3 is attached to the top cabinet 2. When the guide plate member 3 is turned clockwise from the position indicated by the solid line in FIG. 9, the changeover lever 31 is rocked about its axial support portion against the force of the plate spring 39 in FIG. 8 owing to engagement between a slanted portion 54*a* (see FIG. 6) of the driving projection 54 and the slanted portion 42*a* (see FIG. 10) of the operated portion 42. This allows the driving projection 54 to ride up on the operated portion 42 and shift to the position indicated by the two-dot chain line in FIG. 9. The action is the same when the guide plate member 3 is detached. This facilitates the attaching and detaching operations and prevents the related parts from sustaining damage.

Figure 12:
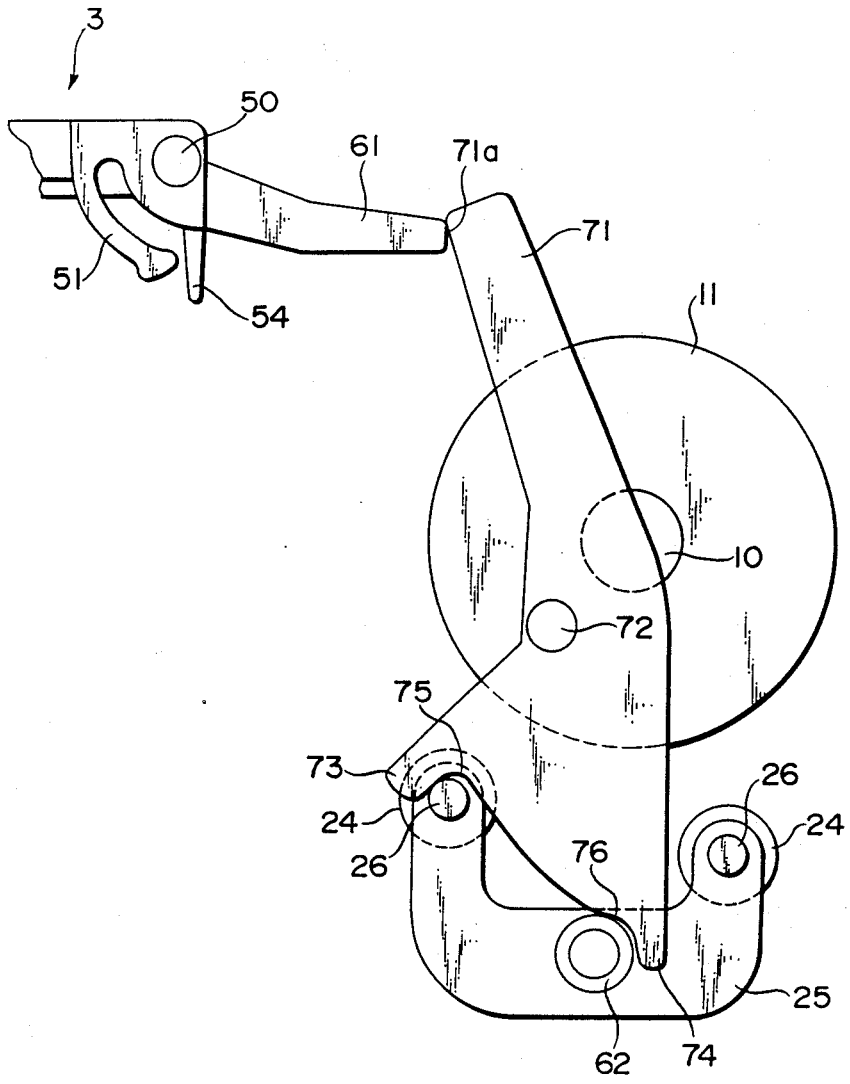
FIG. 12 is an explanatory view showing the arrangement of pressure rollers when the guide plate member is in the accommodated position.
Figure 13:
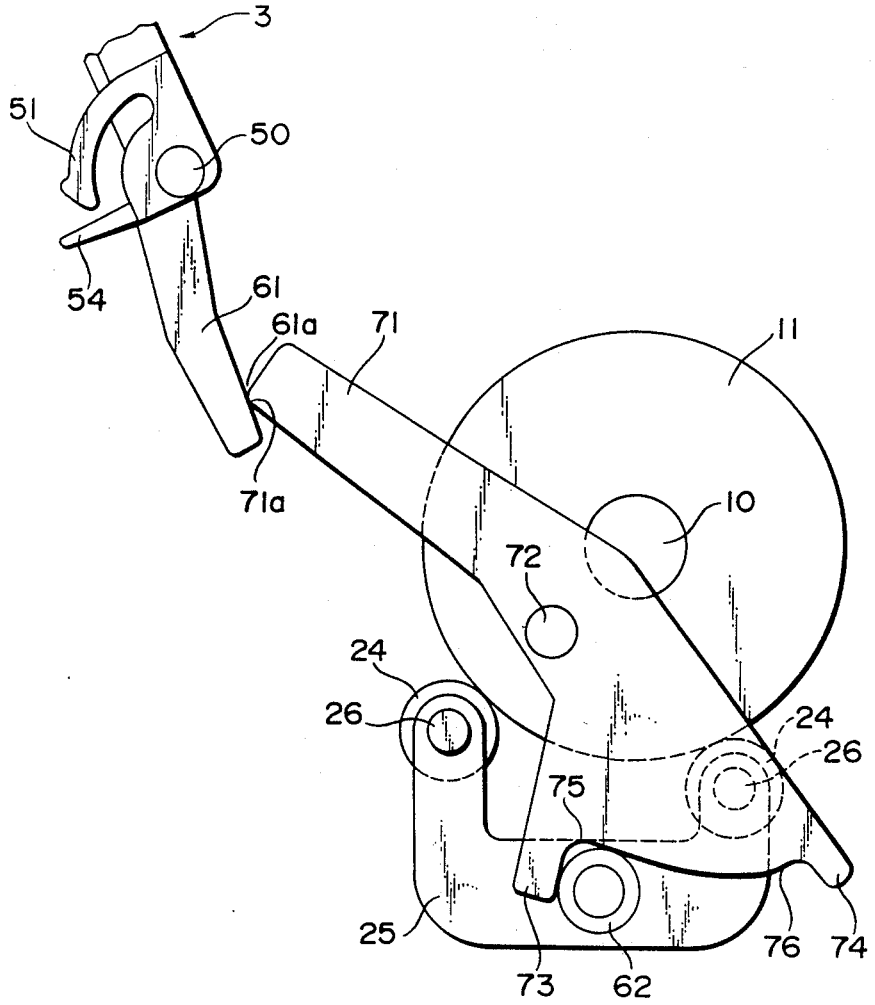
FIG. 13 is an explanatory view showing the guide plate member at a single-form guide position.

FIGS. 12 and 13 are for describing movement of the roller support member 25 by the guide plate member 3, with the printer 1 of the embodiment being viewed from the left side, namely the rear side in FIG. 4. In order to simplify the drawings, portions shown in FIGS. 4 and 5 that do not require description are deleted.

FIG. 12 illustrates the state which prevails when the guide plate member 3 is located in the accommodated position, as shown in FIG. 4. A projection 61 on the guide plate member 3 is provided in the vicinity of the left end thereof, as shown in FIG. 3. Numeral 71 denotes a contact pressure lever pivoted on a shaft 72 supported on the right-side frame opposite the mechanism side frame 28 shown in FIG. 8. The lever 71 is provided between this left-side frame and the platen 11. The roller support member 25 is urged toward the platen 11 at all times by well-known means, not shown. Therefore, the contact pressure lever 71 is biased in the counter-clockwise direction about the shaft 72 by the upwardly directed biasing force ascribable to a shaft 62.

As shown in FIG. 12, the guide plate member 3 is attached at the accommodated position, and an operating end 71*a* of the contact pressure lever 71 is biased in the clockwise direction by the projection 61 of the guide plate member. As a result, the shaft 62 of the roller support member 25 is urged downwardly by a cam portion 76 of the contact pressure lever 71, so that the driven pressure rollers 24 are separated from the platen 11.

FIG. 13 illustrates the state that prevails when the guide plate member 3 is shifted from the attitude shown in FIG. 12 to the raised attitude, as shown in FIGS. 5 and 7.

By thus raising the guide plate member 3, the projection 61, which blocks counter-clockwise rotation of the contact pressure lever 71, is shifted to the left side. Consequently, the biasing force preventing counter-clockwise rotation of the lever 71 no longer acts upon the operating end 71*a* thereof. Therefore, due to the upward urging force produced by the shaft 62, the shaft 62 is slid upwardly along edge 75 from the cam portion 76 of contact pressure lever 71. As a result, the contact pressure lever 71 turns in the counter-clockwise direction. Thus, the driven pressure rollers 24 are pressed against the platen 11 and cooperate with the platen to feed a single form.

The projection 61 has an upper portion 61*a* near the tip thereof. The upper portion 61*a* is flattened and smoothened by chamfering so that the operating end 71*a* of the pressure contact lever 71 can easily slide thereon. By operating the handle 8 in the state shown in FIG. 13, the pressure rollers 24 are separated from the platen 11 so that a single form wound about the platen 11 can be extracted by hand. At this time the lever 71 is retained at the position shown in FIG. 13. When the handle 8 is re-operated to direct the driven pressure rollers 24 to apply force to the platen 11, the rollers 24 are restored to the state shown in FIG. 13.

Thus, when the guide plate member 3 is in the accommodated position, as shown in FIG. 4, namely when continuous forms are being used, the driven pressure rollers 24 are separated from the platen 11 and the continuous forms are fed toward the printing head 13 by the pin tractor mechanism. When the guide plate member 3 is in the raised attitude, as shown in FIG. 5, namely when single forms are being used, the driven pressure rollers 24 are brought into pressured contact with the platen 11, so that a single form is fed to the printing head 13 by cooperation between the platen 11 and the driven pressure rollers 24.

When the continuous forms are initially loaded in the arrangement described above, the guide plate member 3 is raised, as shown in FIG. 1, to expose the pin tractor mechanism 4. With the paper stay 49 in the open state the pins 48*a* of the left and right pin belts 48 are engaged with the small holes on both sides of the continuous forms, after which the paper stay 49 is returned to the paper pressing position. In this initial loading operation, the leading end of the continuous forms can be engaged with the pin belt 48 with comparative ease since the pin tractor mechanism 4 is situated upstream of the platen in terms of paper feed (the so-called "push-feed method") and is disposed in a horizontal state, as will be appreciated from the foregoing description.

When the guide plate member 3 is returned to the horizontal accommodated position after the continuous forms are loaded in the manner mentioned above, the motor 12 is capable of transmitting a rotating force to the tractor drive shaft 32. Therefore, in response to initial rotation of the motor 12, the leading edge of the continuous forms is passed around the platen 11 from the guide path 18 and is brought to a position beyond the bail roller 20 to prepare for printing. Then, in response to printing command, the printing head 13 is conveyed, the printing wire is driven and the continuous forms are fed by the pin tractor mechanism 4 whereby printing is performed on the continuous forms. At this time the driven pressure rollers 24 are situated at the position spaced away from the platen 11, as mentioned earlier.

In order to print on a single form after printing on the continuous forms ends, the continuous forms are torn off at the set of perforations that follows the portion having the last item of printed data, after which the knob 7 is manipulated to turn the tractor drive shaft 32 in the reverse direction together with the platen 11. (When the clutch gear 27 is in the state in which it is capable of transmitting the rotating force of the motor, the platen 11 and the tractor drive shaft 32 turn synchronously.) As a result, the leading edge of the continuous forms is positioned on the pin tractor mechanism 4. Next, with the continuous forms left in engagement with the pin tractor mechanism 4, the guide plate member 3 is raised to the paper insertion guide position shown in FIGS. 5 and 7, as described earlier. This causes the transmission of rotating force to the tractor drive shaft 38 by clutch gear 27 to be interrupted, as already described, so that only the platen 11 receives drive from the motor 12.

Since the driven pressure rollers 24 are situated at this time at the position where they are pressed against the platen 11, as set forth above, the single form is fed to the periphery of the platen 11 from the guide path 17 along the raised guide plate member 3. When the platen 11 is fed a predetermined amount by the motor 12 or by manual operation and the leading edge of the single form is pressingly engaged by the bail roller 20, a state is attained in which it is possible to print on the single form. Thereafter, in response to a printing command, printing is performed on the single form by transport of the printing head, drive of the printing wire and feed of the single form by the friction paper feed mechanism. Though the leading edge of the continuous forms is engaged with the pin tractor mechanism 4 at this time, the pin tractor mechanism 4 is not driven by the motor 12 and, hence, there is absolutely no risk of the continuous forms being fed when the single form is fed.

In order to subsequently print on the continuous forms again, the single form whose printing has been completed is extracted and then the guide plate member 3 is again returned to the horizontal accommodated position, whereupon it becomes possible to feed the continuous forms just as described above. Thus, the continuous forms can be feed immediately without requiring that they first be engaged with the pin belt 48.

Thus, in accordance with the present invention, in a printer having a single-form feed function and a continuous-form feed function wherein a pin tractor mechanism is situated upstream of a platen in terms of the paper feed direction, there is provided a paper feed apparatus in which, when single forms are used, the continuous forms can be kept engaged with the pin tractor mechanism and the operator is capable of cutting off the transmission of rotating force to the pin tractor mechanism in a simple and reliable manner.

As many apparently widely different embodiments of the present invention can be made without departing from the spirit and scope thereof, it is to be understood that the invention is not limited to the specific embodiments thereof except as defined in the appended claims.

What is claimed is:

1. A printer paper feed apparatus for feeding single and continuous forms comprising:

a platen rotatively driven by a paper feed motor;

a printer main body having an upper side including a single-form insertion inlet;

a pin tractor mechanism situated upstream in terms of paper feed as seen from said platen for feeding the continuous forms, said pin tractor mechanism having a tractor drive shaft;

a guide plate member for the single forms having a base end pivotally supported in the vicinity of the single-form insertion inlet, said guide plate member being capable of selectively assuming a horizontally accommodated position and a paper insertion guide position inclined with respect to said accommodated position;

a rotating force transmission system including clutch means provided between the tractor drive shaft of said pin tractor mechanism and said paper feed motor, said clutch means including a gear capable of sliding along a rotary shaft between a first position at which said gear meshes with a drive gear for driving said drive shaft of said pin tractor mechanism and a second position at which said gear is unmeshed with said drive gear; and clutch control means for controlling engagement and disengagement of said clutch means in dependence upon whether said guide plate member is situated at the accommodated position or the single-form insertion guide position;

wherein when said guide plate member is situated at the single-form insertion guide position, said clutch means is placed in a state in which the rotating force cannot be transmitted from said paper feed motor to said tractor drive shaft, thereby terminating drive of said pin tractor mechanism.

2. The paper feed apparatus according to claim 1, wherein said clutch control means includes a lever supported on a shaft and turnable about the shaft, said lever having a first end portion for engaging a projection on said guide plate member, and a tapered portion provided in the vicinity of a second end opposite said first end, wherein when said guide plate member is raised, said first end engages said projection to turn said lever, said gear being slidingly shifted to the second position by said tapered portion of said lever.

3. The paper feed apparatus according to claim 1, wherein said paper insertion inlet has a single-form insertion opening and a continuous-form insertion opening which are partitioned from each other by a partitioning member, said continuous-form insertion opening being provided below said single-form insertion opening.

4. The paper feed apparatus according to claim 1, wherein said pin tractor mechanism is disposed below said guide plate member in the accommodated position.

5. The paper feed apparatus according to claim 1, wherein said guide plate member is adapted so as to be detachable from the printer main body.

6. A paper feed apparatus for a printer having a platen rotatably driven by a paper feed motor and equipped with a single-form feed function for feeding single forms and a continuous-form feed function for feeding continuous forms, said paper feed apparatus comprising:

driven pressure rollers having a support shaft and being capable of assuming a first position for feeding single forms in cooperation with said platen and a second position at which said driven pressure rollers are spaced away from said platen;

a pin tractor mechanism for feeding continuous forms to the platen and being situated upstream in terms of paper feed with respect to said platen, said pin tractor mechanism including a tractor drive shaft;

a printer main body having a paper insertion inlet;

a guide plate member for single forms having a base end pivotally supported in the vicinity of said paper insertion inlet, said guide plate member being capable of selectively assuming a horizontally accommodated position and a single-form insertion guide position inclined with respect to said accommodated position;

a rotating force transmission system having clutch means provided between said tractor drive shaft of said pin tractor mechanism and said paper feed motor;

clutch control means for controlling engagement and disengagement of said clutch means in dependence upon whether said guide plate member is situated at the accommodated position or the single-form insertion guide position; and roller transfer means for transferring said driven pressure rollers to the first and second positions in dependence upon whether said guide plate member is situated at the accommodated position or the single-form insertion guide position, wherein said roller transfer means includes a lever supported on a shaft and turnable about the shaft, said lever having a first end including a first end portion for engaging ā projection on said guide plate member and a second end having a cam portion, said support shaft of said driven pressure roller sliding said cam portion such that said driven pressure rollers are capable of assuming said first and second positions.

7. The paper feed apparatus according to claim 6, further comprising a manual lever capable of moving said driven pressure rollers between the first and second positions, wherein said driven pressure rollers are manually movable to the second position even when said driven pressure rollers have been moved to the first position by said roller transfer means.

8. The paper feed apparatus according to claim 6, wherein said paper insertion inlet has a single-form insertion opening and a continuous-form insertion opening which are partitioned from each other by a partitioning member, said continuous-form insertion opening being provided below said single-form insertion opening.

9. The paper feed apparatus according to claim 6, wherein said pin tractor mechanism is disposed below said guide plate member in the accommodated position.

10. The paper feed apparatus according to claim 6, wherein said guide plate member is adapted so as to be detachable from the printer main body.

11. A paper feed apparatus for a printer having a platen rotatably driven by a paper feed motor and equipped with a single-form feed function for feeding single forms and a continuous-form feed function for feeding continuous forms, said paper feed apparatus comprising:

driven pressure rollers having a support shaft and being capable of assuming a first position for feeding single forms in cooperation with said platen and a second position at which said driven pressure rollers are spaced away from said platen;

a pin tractor mechanism for feeding continuous forms to the platen and being situated upstream in terms of paper feed with respect to said platen, said pin tractor mechanism including a tractor drive shaft;

a printer main body having a paper insertion inlet;

a guide plate member for single forms having a base end pivotally supported in the vicinity of said paper insertion inlet, said guide plate member being capable of selectively assuming a horizontally accommodated position and a single-form insertion guide position inclined with respect to said accommodated position;

a rotating force transmission system having clutch means provided between said tractor drive shaft of said pin tractor mechanism and said paper feed motor;

clutch control means for controlling engagement and disengagement of said clutch means in dependence upon whether said guide plate member is situated at the accommodated position or the single-form insertion guide position; and roller transfer means for transferring said driven pressure rollers to the first and second positions in dependence upon whether said guide plate member is situated at the accommodated position or the single-form insertion guide position;

wherein said clutch means includes a gear capable of sliding along a rotary shaft rotated by said paper feed motor, between a first position at which said gear meshes with a drive gear for driving said drive shaft of said pin tractor mechanism and a second position at which said gear is unmeshed with respect to said drive gear.

12. The paper feed apparatus according to claim 11, wherein said clutch control means includes a lever supported on a shaft and turnable about the shaft, said lever having a first end portion for engaging a projection on said guide plate member, and a tapered portion provided in the vicinity of a second end opposite said first end, wherein when said guide plate member is raised, said first end engages said projection to turn said lever, said gear being slidingly shifted to the second position by said tapered portion of said lever.

13. A printer paper feed apparatus comprising:

a printer cabinet;

a rotatable platen;

a paper feed motor for rotating said platen;

a pin tractor mechanism for feeding continuous forms, said pin tractor mechanism being situated upstream in terms of paper feed with respect to said platen, said pin tractor mechanism including a tractor drive shaft;

a printer main body having a single-form insertion inlet formed in an upper side thereof;

a guide plate member for single forms having a base end pivotally supported in the vicinity of said single-form insertion inlet, said guide plate member being capable of selectively assuming a horizontally accommodated position and a paper insertion guide position inclined with respect to said accommodated position;

a rotating force transmission system including clutch means positioned between the tractor drive shaft of said pin tractor mechanism and said paper feed motor;

clutch control means for controlling the engagement and disengagement of said clutch means in response to whether said guide plate member is in said accommodated position or in said paper insertion guide position;

wherein when said guide plate members are situated at said single-form insertion guide position, said clutch means is placed in a state in which the rotating force cannot be transmitted from said paper feed motor to said tractor drive shaft, thereby terminating the drive of said pin tractor mechanism, and wherein when said guide plate member is in said paper insertion guide position, arcuate flexible tip portions provided at lower portions of respective side pieces provided on both sides of said guide plate member engage an upper portion of the printer cabinet so that said guide plate member is held at an inclination of about 60°.

14. A paper feed apparatus for a printer having a platen rotatably driven by a paper feed motor and equipped with a single-form feed function for feeding single forms and a continuous-form feed function for feeding continuous forms, said paper feed apparatus comprising:

driven pressure rollers having a support shaft and being capable of assuming a first position for feeding single forms in cooperation with said platen and a second position at which said driven pressure rollers are spaced away from said platen;

a pin tractor mechanism for feeding continuous forms to the platen and being situated upstream in terms of paper feed with respect to said platen, said pin tractor mechanism including a tractor drive shaft;

a printer main body having a paper insertion inlet;

a guide plate member for single forms having a base end pivotally supported in the vicinity of said paper insertion inlet, said guide plate member being capable of selectively assuming a horizontally accommodated position and a single-form insertion guide position inclined with respect to said accommodated position;

a rotating force transmission system having clutch means provided between said tractor drive shaft of said pin tractor mechanism and said paper feed motor;

clutch control means for controlling engagement and disengagement of said clutch means in dependence upon whether said guide plate member is situated at the accommodated position or the single-form insertion guide position; and roller transfer means for transferring said driven pressure rollers to the first and second positions in dependence upon whether said guide plate member is situated at the accommodated position or the single-form insertion guide position;

wherein said guide plate member includes arcuate flexible tip portions provided at lower portions of respective side pieces provided on both sides of said guide plate member, and wherein when said guide plate member is inclined said arcuate flexible tip portions engage an upper portion of a printer cabinet so that said guide plate member is held at an inclination of about 60°.

* * * * *